US008154202B2

(12) United States Patent
Fuchs et al.

(10) Patent No.: US 8,154,202 B2
(45) Date of Patent: Apr. 10, 2012

(54) STARTER MEMBER FOR A LOW-PRESSURE DISCHARGE LAMP

(75) Inventors: Kirsten Fuchs, Kissing (DE); Gerald Hämmer, Königsbrunn (DE); Paul Lange, Friedberg (DE); Viktor Malik, Diedorf (DE); Thomas Noll, Kipfenberg (DE); Klaus Pankratz, Freihalden (DE)

(73) Assignee: OSRAM AG, Munich (DE)

( * ) Notice: Subject to any disclaimer, the term of this patent is extended or adjusted under 35 U.S.C. 154(b) by 270 days.

(21) Appl. No.: 12/311,882

(22) PCT Filed: Oct. 22, 2007

(86) PCT No.: PCT/EP2007/061250

§ 371 (c)(1),
(2), (4) Date: Apr. 15, 2009

(87) PCT Pub. No.: WO2008/052897

PCT Pub. Date: May 8, 2008

(65) Prior Publication Data

US 2009/0322223 A1 Dec. 31, 2009

(30) Foreign Application Priority Data

Nov. 3, 2006 (DE) ..... 10 2006 052 026

(51) Int. Cl.
*H01J 17/49* (2012.01)
*F04F 9/00* (2006.01)

(52) U.S. Cl. ..... 313/553; 417/48; 313/561; 313/491

(58) Field of Classification Search ..... 313/553, 313/561, 554, 491; 417/48, 51
See application file for complete search history.

(56) References Cited

U.S. PATENT DOCUMENTS

| | | | |
|---|---|---|---|
| 4,972,118 | A | 11/1990 | Yorifuji et al. |
| 5,719,465 | A | 2/1998 | Den Breeijen et al. |
| 6,099,375 | A | 8/2000 | della Porta |
| 6,107,737 | A | 8/2000 | della Porta |
| 6,476,553 | B1 | 11/2002 | Iida et al. |
| 2002/0057059 | A1 | 5/2002 | Ogishi et al. |

FOREIGN PATENT DOCUMENTS

| | | | |
|---|---|---|---|
| CN | 2560092 | | 9/2003 |
| DE | 1 060 991 | | 7/1959 |
| DE | 696 07 741 | T2 | 11/1995 |
| DE | 195 28 390 | A1 | 2/1997 |
| EP | 0 327 346 | A2 | 8/1989 |
| EP | 0 327 346 | A3 | 8/1989 |
| EP | 1 069 595 | A1 | 1/2001 |
| EP | 1 069 595 | B1 | 1/2001 |
| EP | 1 176 627 | A2 | 1/2001 |
| WO | WO 96/19823 | A1 | 6/1996 |
| WO | WO 97/19461 | A1 | 5/1997 |
| WO | WO 2006/075347 | A2 | 7/2006 |
| WO | WO 2006/075347 | A3 | 7/2006 |
| WO | WO 2008/055873 | A3 | 5/2008 |

*Primary Examiner* — Joseph L Williams

(74) *Attorney, Agent, or Firm* — Holtz, Holtz, Goodman & Chick, PC

(57) ABSTRACT

Disclosed is a starter member to which a mercury-absorbing layer is applied and which can be used in low-pressure mercury discharge lamps. A starter member for a low-pressure amalgam discharge lamp comprises a mercury-absorbing layer on a base. A coating layer which is provided on the mercury-absorbing layer has a getter effect and prevents the material of the mercury-absorbing layer from coming off.

15 Claims, 3 Drawing Sheets

STARTER MEMBER FOR A LOW-PRESSURE DISCHARGE LAMP

This application is a U.S. National Phase Application under 35 USC 371 of International Application PCT/EP2007/061250, filed Oct. 22, 2007, which is incorporated herein in its entirety by this reference.

TECHNICAL FIELD

The present invention relates to a startup element for a low-pressure discharge lamp, i.e. in particular a mercury low-pressure discharge lamp and an amalgam low-pressure discharge lamp, to a low-pressure discharge lamp with such a startup element and to a process for the production of such a startup element.

PRIOR ART

Mercury low-pressure discharge lamps which, in contrast to amalgam low-pressure discharge lamps, comprise pure mercury in the discharge vessel in order to generate the luminous flux have the advantage that the mercury vapor pressure at room temperature and therefore the initial luminous flux are relatively high.

FIG. 1 shows the luminous flux over the startup time for mercury low-pressure discharge lamps. It can be seen from FIG. 1 that the immediate light shortly after the low-pressure discharge lamp is switched on is only at a value of 30% in comparison with the stabilized value present after 180 seconds.

The document DE 69607741T2 has disclosed an apparatus for mercury emission for the absorption of reactive gases and for electrode shielding in low-pressure discharge lamps, with strips of mercury-emitting material and pulverulent getter material being rolled next to each other onto a metallic strip in a cold-rolling process. These strips can be used to form so-called shielding plates, which are arranged in the vicinity of the electrode or surround said electrode. This makes it possible to prevent emitter material which has been removed by means of sputtering from being deposited on the phosphor layer in the electrode region, which prevents blackening. By means of the use of getter materials, reactive gases, such as hydrogen, oxygen and water which impair the operational reliability of the fluorescent tubes, are avoided. In such a low-pressure discharge lamp, the metallic strip has the function of the emission of mercury, the sorption of reactive gases and electrode shielding. However, the luminous flux startup of such a mercury low-pressure discharge lamp does not yet entirely meet the expectations of the user.

Amalgam low-pressure discharge lamps have a low mercury vapor pressure at room temperature, as a result of which the initial luminous flux is relatively low, and the startup time is additionally relatively long as a result of an only slow increase in the vapor pressure after the lamp is switched on.

In a known embodiment of the amalgam low-pressure discharge lamps, both a working amalgam and a startup amalgam are provided. The startup amalgam is located in the vicinity of the filament, for example on the glass bead holding the power supply wires together. Such a startup amalgam can be used to reduce the startup time. A precondition for this is the fact that there is sufficient time prior to the lamp being switched on for a sufficient quantity of mercury to be absorbed by the startup amalgam.

It is apparent from FIG. 2 that, in the case of such amalgam low-pressure discharge lamps, a luminous flux hole occurs up to approximately 2000 seconds after the low-pressure discharge lamp is brought into commission. This arises from the fact that, after an emission of the mercury by the startup flag, oversaturation of the gas phase with mercury occurs. When the working amalgam has absorbed the liquid mercury substantially completely, the luminous flux begins to increase again.

DESCRIPTION OF THE INVENTION

The object of the present invention is to provide a startup element for a low-pressure discharge lamp, by means of which startup element an increased luminous flux is made possible once the low-pressure discharge lamp has been switched on and the life of the lamp is increased. In addition, a low-pressure discharge lamp with such a startup element and a process for the production of such a startup element will be provided.

This object is achieved according to the invention by the features of claims 1, 3, 8 and 14.

A startup element for a mercury low-pressure discharge lamp is provided, which startup element comprises a mercury-absorbing layer, by means of which mercury can be absorbed in the off time of the lamp between two starts. As a result, the startup response of the low-pressure discharge lamp can be improved.

The startup element preferably has a coating layer which covers at least sections of the mercury-absorbing layer, does not form an amalgam with mercury and preferably comprises titanium. As a result, the oxidation of the mercury-absorbing layer which can take place, for example, during the production process can be reduced and, at the same time, a getter effect can be achieved.

In addition, according to the invention a startup element for an amalgam low-pressure discharge lamp is provided, which startup element has a mercury-absorbing layer, by means of which mercury can be absorbed prior to starting of the lamp, and a coating, which covers at least sections of the mercury-absorbing layer. The coating does not form an amalgam with mercury and preferably comprises titanium. In this way, even in the case of amalgam low-pressure discharge lamps, the getter effect can be utilized and the oxidation response of the mercury-absorbing layer can be improved. As a result, a luminous flux hole with a relatively small length and a relatively small depth can be obtained.

It is preferred if the mercury-absorbing layer comprises indium, which makes it possible to realize rapid absorption and emission of mercury.

The titanium-comprising coating is preferably produced from titanium powder, Bentone and water, with the result that an excellent getter effect can be realized.

In a preferred embodiment, titanium is applied in a quantity of approximately 1 to 2 mg, preferably 1.5 mg, with the result that, alongside effective blocking of the oxidation of the mercury-absorbing layer, excellent absorption and emission of the mercury by the mercury-absorbing layer can be realized and, at the same time, the getter effect of the coating layer can be realized.

The startup element preferably has a basic body, which is formed from stainless steel, since this does not enter into an amalgam bond with mercury.

In addition, according to the invention a low-pressure discharge lamp with a discharge vessel, two electrodes and an above-described startup element is provided, which startup element is arranged in the vicinity of at least one of the electrodes. This ensures that when the titanium coating layer is applied, the required temperature range for the getter effect of the titanium can be achieved.

In an embodiment of the low-pressure discharge lamp, a startup element is associated with each of the electrodes, with the result that the startup response of the low-pressure discharge lamp is favored at each electrode.

It is preferable for the distance between the startup element and a filament of an electrode to have been selected in such a way that the temperature at the startup element is in the range of between 250° C. and 400° C., more preferably in the range of between 300 and 350° C. in order to achieve an excellent getter effect.

The distance between the startup element and a filament of an electrode is preferably 1 to 2 mm, with the result that the temperature at the startup element for the getter effect can be achieved.

The mercury-absorbing layer has more preferably been provided on the startup element in such a quantity that the quantity of mercury released by the startup element substantially compensates for the loss of mercury caused by adsorption in the starting phase of the lamp. As a result, oversaturation of the gas phase with mercury is avoided and an excellent startup response is achieved.

It is also preferable for the mercury-absorbing layer to have been provided on the startup element in such a quantity that it absorbs mercury in the range of approximately 5 to 10% of the quantity of mercury in the discharge vessel. The inventor has established by experimental means that this range is favorable for particularly rapid startup of the low-pressure discharge lamp.

In addition, a process for the production of a startup element for a low-pressure discharge lamp is provided having the steps of: providing a basic body, applying a mercury-absorbing layer to the basic body, and providing a paste which comprises titanium and applying said paste to at least sections of the mercury-absorbing layer. This makes it possible in a simple manner to produce a startup element with a low degree of complexity in terms of apparatus.

It is preferable for the coating layer to be applied by means of dip-coating, which simplifies the production process. In a further step, once the mercury-absorbing layer and titanium have been applied, the basic body can be dried, with the result that the startup element is available within a short period of time.

It is preferable for the steps of applying titanium and drying to be repeated at least once in order to achieve the desired layer thickness.

Particularly advantageous configurations are given in the dependent claims.

BRIEF DESCRIPTION OF THE DRAWINGS

The invention will be explained in more detail below with reference to a preferred exemplary embodiment. In the drawings.

PREFERRED EMBODIMENT OF THE INVENTION

Figure 3:
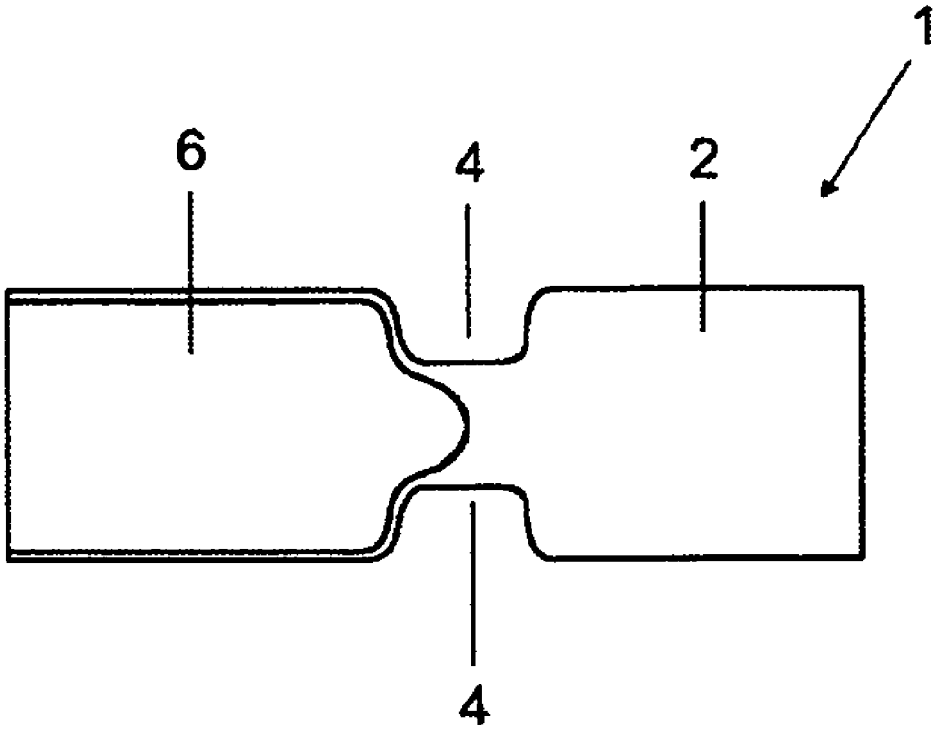
FIG. 3 shows a startup flag with a mercury-absorbing layer applied for a mercury low-pressure discharge lamp.

FIG. 3 shows a startup element for a mercury low-pressure discharge lamp corresponding to the first exemplary embodiment. This startup element 1 has a basic body 2 made from flat material in the form of a strip, which basic body is preferably manufactured from stainless steel. This basic body 2 is split approximately in the center into two halves by a constriction 4. One of the halves, the right-hand half in FIG. 3, is used for fastening the startup flag adjacent to an electrode of the low-pressure discharge lamp, and the other half, the left-hand half in FIG. 3, is used for applying a mercury-absorbing layer 6.

In the exemplary embodiment shown, this mercury-absorbing layer 6 comprises indium. By means of the layer 6 applied, the intention is for mercury from the discharge vessel of the low-pressure discharge lamp into which the startup element 1 has been introduced to be absorbed in the switched-off state of the low-pressure discharge lamp and to be emitted when said lamp is switched on.

Since the startup flag is arranged in the vicinity of the heated electrode, there is a rapid release of mercury. This released mercury is intended to compensate for the loss of mercury owing to the physical adsorption of mercury on the fluorescent layer on the inside of the discharge vessel. It is therefore preferable for the quantity of indium to be provided in such a way that the quantity of mercury absorbed and emitted by the indium layer is at least as great as the quantity of Hg which is absorbed by the phosphorizing layer of mercury in the starting phase of the lamp owing to the physical adsorption, but is preferably so great that, in the event of complete evaporation in the lamp, a vapor pressure of a few pascals is generated.

Figure 1:
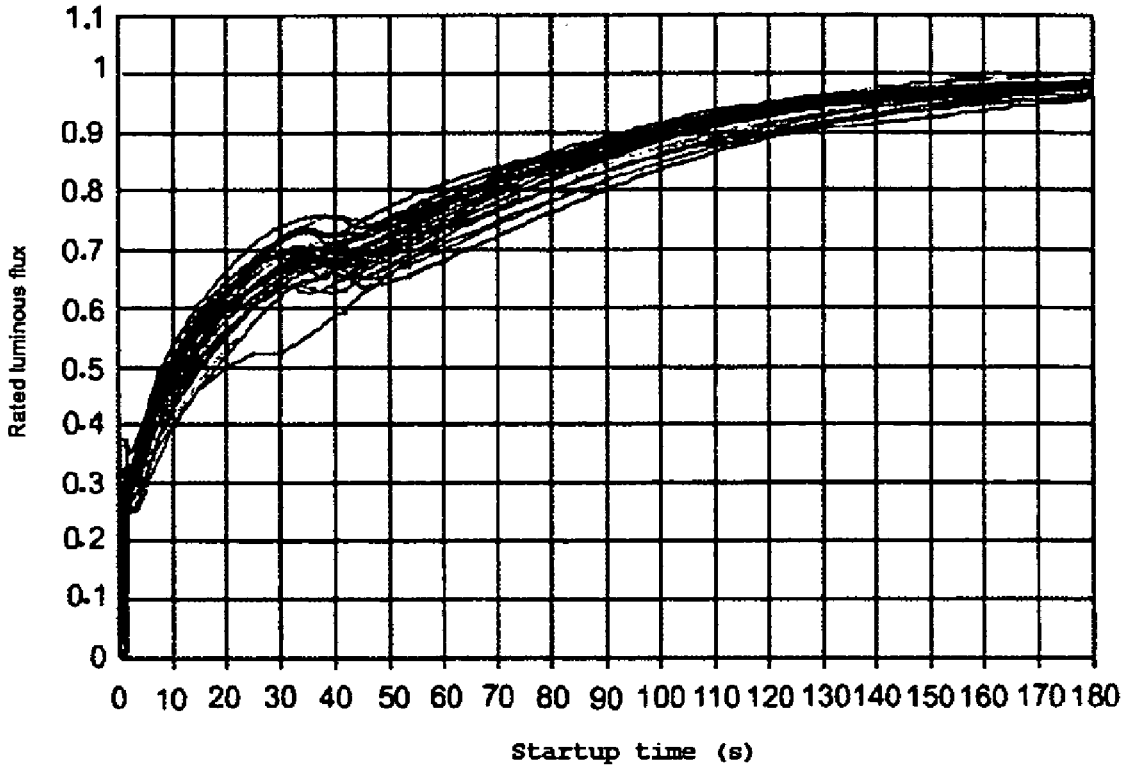
FIG. 1 shows an illustration of the luminous flux over the startup time in a mercury low-pressure discharge lamp.

By means of a startup element 1 according to the invention, the startup luminous flux increases once the mercury low-pressure discharge lamp has been switched on in comparison with FIG. 1. Owing to the provision of an indium layer on a startup element for mercury low-pressure discharge lamps, but also for amalgam low-pressure discharge lamps, there is a large number of problems:

Since the discharge vessel is subjected to increased temperatures in the course of the production process, the indium oxidizes on the startup element, which in turn results in an impaired startup response of the low-pressure discharge lamp. This oxidation can be minimized by enlarging the distance between the startup element and the pinch seal, but this results in other disadvantages, for example lamp ends which are too long.

The quantity of indium is reduced by a multiplicity of factors. The indium creeps along a gradient from a low temperature to a relatively high temperature, with the power supply line generally being severely oxidized. In addition, sputtering of indium owing to the discharge takes place, in particular as a result of additional contamination of the lamp and, in the case of a DC connection, between the startup element and the power supply line. A way of circumventing this problem is to introduce the startup element into the glass bead, but this would result in further manufacturing problems. Providing an excess quantity of indium in comparison with the quantity of 0.5 to approximately 1 mg per flag used in the present invention results in increased costs during the production of the indium layer.

Figure 2:
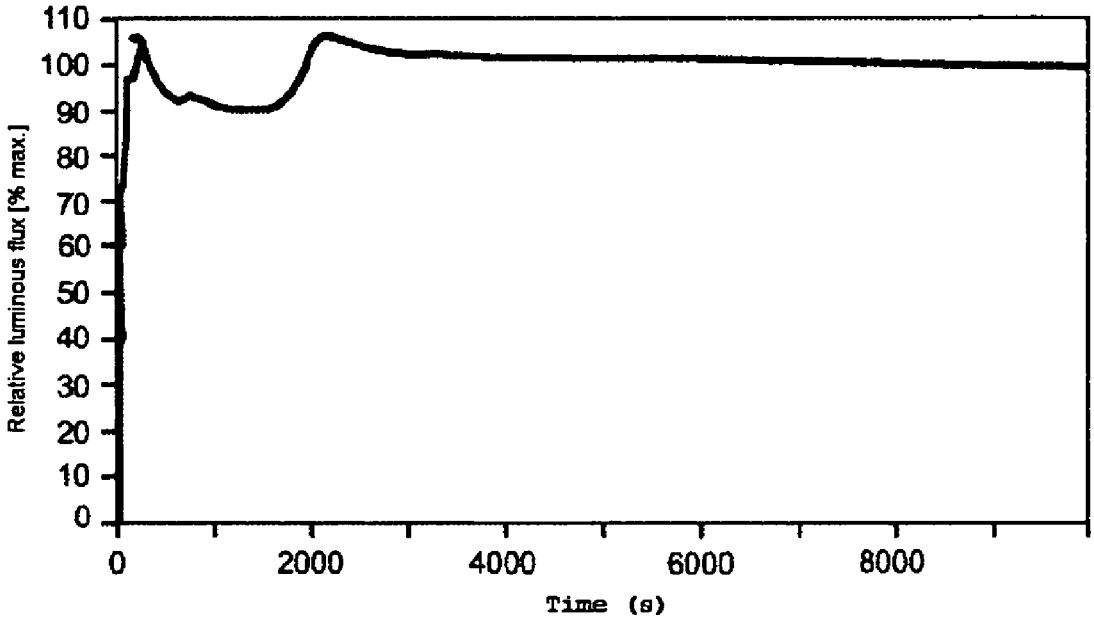
FIG. 2 shows the relative luminous flux over time in an amalgam low-pressure discharge lamp.

In the case of amalgam low-pressure discharge lamps, a considerable overshoot of the mercury vapor pressure occurs during the startup phase, as a result of which the luminous flux hole shown in FIG. 2 arises after approximately two minutes. This overshoot can be reduced by a reduction in the quantity of indium, but the oxidation losses mentioned above arise, with the result that a reduction in the quantity of indium is not a suitable solution.

There are impurities in the discharge vessel from the pumping process. In addition, impurities arise over the life of the lamp in particular as a result of the decomposition of water owing to the discharge, as a result of which the concentration of hydrogen, for example, also increases over the life. This is expressed in a rise in the running voltage, which negatively influences the life of the lamp. These effects can be reduced by long process times and high temperatures during pumping. However, this results in increased production complexity.

Figure 4:
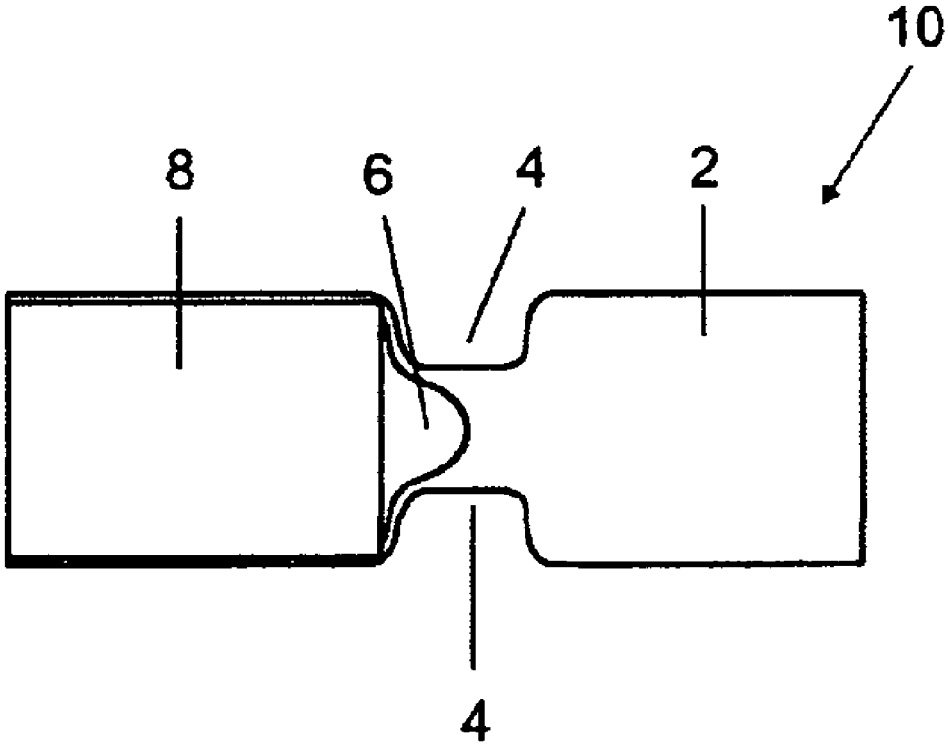
FIG. 4 shows a startup flag with an indium layer applied and a titanium-containing layer applied for a mercury low-pressure discharge lamp or an amalgam low-pressure discharge lamp.

The abovementioned disadvantages of the mercury-emitting layer on the startup element 1 from FIG. 3 can be eliminated by a startup element 10 from FIG. 4, which can be inserted into mercury low-pressure discharge lamps and amalgam low-pressure discharge lamps. The basic body 2 with the constriction 4 and the mercury-absorbing layer 6 of the startup element 10 from FIG. 4 correspond to those from FIG. 3. In addition, a coating layer 8 which comprises titanium is applied to the mercury-absorbing layer 6 in FIG. 4.

This application process can take place as follows, for example:

Firstly, a paste consisting of titanium powder and a rheological additive is prepared and then this paste is applied to the startup element 1, which has the indium coating 6, by means of dip-coating. Then, the coating layer is dried. Depending on the desired layer thickness and the desired quantity of titanium on the startup element 10, the dip-coating and drying process can be repeated one or more times.

With such a coating layer 8 applied to at least sections of the mercury-absorbing layer 6, it is possible to markedly reduce oxidation during the production process without the startup response of the low-pressure discharge lamp being impaired. In addition, the coating layer represents a considerable impediment to the action of the indium creeping along the temperature gradient. Sputtering of indium is also greatly reduced since the coating layer is the outer layer and therefore titanium is sputtered first.

In the case of amalgam low-pressure discharge lamps, it is also possible to provide a considerable reduction in the quantity of indium, as a result of which costs can be reduced and an overshoot in the luminous flux is reduced.

Since the coating layer considerably reduces oxidation of the indium, the distance between the filament and the startup element can be reduced, for example, to 1 to 2 mm. As a result, the startup element can be heated more quickly and a quicker startup response results in comparison with startup elements which have been fitted at a greater distance from the filament.

In the case of a small distance between the filament and the startup element, the startup element will now become hot enough for the coating layer to be capable of having a getter effect, in particular for hydrogen, which results from the decomposition of water. As a result, it is possible to extend the life.

When designing the coating layer, in particular in view of its thickness and the particle size, the mercury diffusion both in the direction of the mercury emission of the layer 6 and the mercury absorption of the layer 6 as well as the function of the coating layer as a getter, as resistance to oxidation and as a barrier to creepage need to be taken into account.

The improved startup response owing to the startup elements 1 and 10 according to the invention also has an effect on the use of the electronic ballasts for the low-pressure discharge lamp. The increased luminous flux once the low-pressure discharge lamp has been switched on can be taken into account in the design of the circuit.

Figure 5:
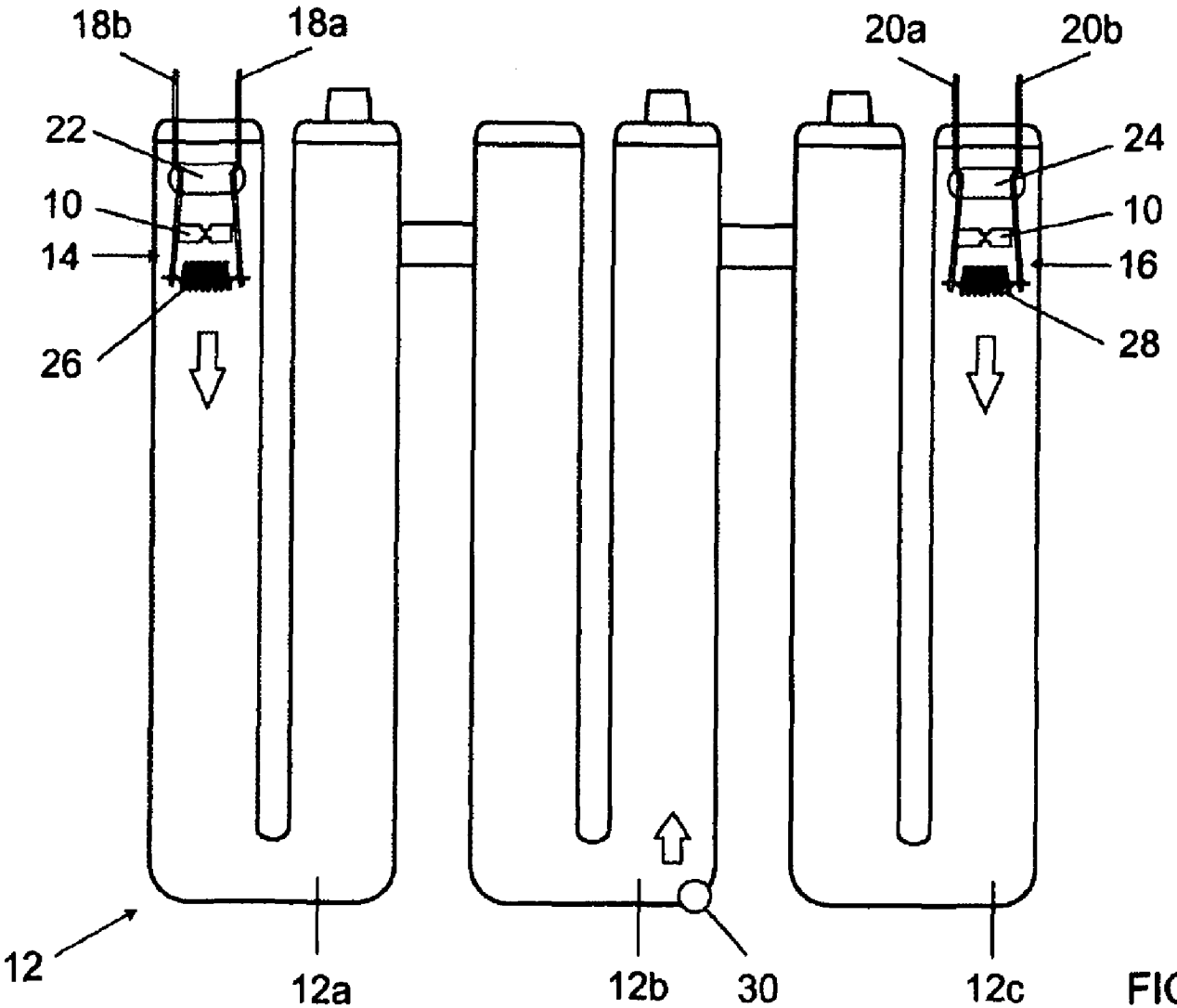
FIG. 5 shows a discharge vessel of a mercury low-pressure discharge lamp with startup flags according to the invention in a schematic illustration.

FIG. 5 illustrates a mercury low-pressure discharge lamp which has a discharge vessel 12, which has three vessel segments 12*a*, 12*b*, 12*c*, whose discharge areas are joined to one another. Each of these segments 12*a*, 12*b*, 12*c* is substantially U-shaped. In order to simplify the illustration, the segments, which are normally arranged with 120° symmetry, are illustrated next to one another. Low-pressure discharge lamps with such discharge vessels are marketed by OSRAM, for example under the designation "DULUX EL". The inner surfaces of the discharge vessel 12 are coated with a powder consisting of fluorescent material, and the discharge vessel is filled with a noble gas, for example argon or neon, and with mercury vapors.

An electrode 14, 16 is provided on each of the end sections of the discharge vessel. Each of the electrodes has power supply wires 18*a*, 18*b*, 20*a*, 20*b*, which are led out of the discharge vessel and are fixed via a glass bead 22, 24 and lead to the respective filaments 26, 28. A startup element 10 according to the invention is provided adjacent to the filament 26, 28 between the glass beads 22, 24 and the respective filament 26, 28. A cold spot 30 at which liquid mercury collects during conventional operation of the lamp in an inverted position, is illustrated on the central segment 12*b* of the discharge vessel 12.

During operation of the lamp, the temperature at this cold spot determines the mercury vapor pressure in the lamp. If the lamp is switched off, the startup elements 10 cool down, which results in it being possible for said startup elements to absorb mercury from the gas phase, and this mercury is delivered from the cold spot 30 until an equilibrium has been set.

If the lamp is switched on, the startup elements 10 are heated more quickly than the cold spot 30. During starting of the lamp, mercury which has been lost from the gas phase is therefore delivered subsequently via the startup elements substantially more quickly than via the cold spot, which ultimately results in an improvement in the startup response.

By means of the startup element 10, rapid emission of mercury takes place owing to the proximity to the filaments 26, 28, while liquid mercury is present at the cold spot 30 owing to the low temperature present and only slow emission of mercury takes place when the low-pressure discharge lamp is switched on.

In the case of amalgam low-pressure discharge lamps (not illustrated in the figures), the mercury is rearranged from startup amalgam into working amalgam, and vice versa, owing to the different vapor pressures of working amalgam and startup amalgam in the on and off phases of the lamp. In the switch-on phase, in the meantime a cold spot is formed, by means of which the lamp is made into the mercury lamp.

Any desired working amalgam can be used for the working amalgam in the case of the amalgam low-pressure discharge lamps according to the invention, for example, a working amalgam which has been introduced into the exhaust tube with, for example, an iron disk or iron sphere being arranged in front of said working amalgam, with this disk or sphere preventing the ingress of working amalgam into the discharge vessel. Furthermore, the working amalgam can be introduced into the discharge vessel, for example, in such a way that it is applied to expandable metal. In this case, the distance between the filament and the startup amalgam is smaller than the distance between the filament and the working amalgam.

For an advantageous getter effect of the coating layer 6 both in the case of mercury low-pressure discharge lamps and in the case of amalgam low-pressure discharge lamps it is preferable if the startup element is heated to a temperature in the range of from 250° C. to 400° C., more preferably between 300° C. and 350° C.

The present invention is not restricted to the use of indium as the material for the mercury-absorbing layer 6 and to the use of titanium as the material for the coating layer, but it is possible for any mercury source to be used for the mercury-absorbing layer and for any desired material which prevents the process involving the loss of material from the mercury-absorbing layer and in which there is a getter effect in the operating range used for low-pressure discharge lamps to be used for the coating layer.

The invention discloses a startup element, onto which a mercury-absorbing layer has been applied and which can be used on mercury low-pressure discharge lamps. A startup element for an amalgam low-pressure discharge lamp has a mercury-absorbing layer on a basic body, with a coating layer being located on said mercury-absorbing layer, which coating layer can be used to prevent a process involving the loss of material from the mercury-absorbing layer, and which coating layer has a getter effect.

The invention claimed is:

1. A startup element (1) for a mercury low-pressure discharge lamp or an amalgam low-pressure discharge lamp, which startup element comprises (a) a mercury-absorbing layer (6), by means of which mercury can be absorbed prior to starting of the lamp and (b) a coating (8), which does not form an amalgam with mercury, and covers at least sections of the mercury-absorbing layer (6).

2. The startup element as claimed in claim 1, wherein the mercury-absorbing layer (6) comprises indium.

3. The startup element as claimed in claim 1, wherein the coating (8) is at least partially composed of titanium powder.

4. The startup element as claimed in claim 1, wherein, by means of the coating (8), titanium is applied in a quantity of approximately 1.0 to 2.0 mg/cm$^2$, in flocks.

5. The startup element as claimed in claim 1, wherein the startup element has a basic body (2) made from stainless steel onto which the mercury-absorbing layer (6) and the titanium-comprising coating (8) are applied.

6. A low-pressure discharge lamp with a discharge vessel, two electrodes (14, 16) and a startup element (1, 10) as claimed in claim 1, wherein the startup element (1, 10) is arranged in the vicinity of at least one of the electrodes.

7. The low-pressure discharge lamp as claimed in claim 6, wherein the startup element (1, 10) is associated with each of the electrodes (14, 16).

8. The low-pressure discharge lamp as claimed in claim 6, wherein the distance between the startup element (1, 10) and a filament (26, 28) of an electrode (14, 16) has been selected in such a way that the temperature at the startup element (1, 10) is in the range of between 250° C. and 400° C.

9. The low-pressure discharge lamp as claimed in claim 6, wherein the distance between the startup element (1, 10) and a filament (26, 28) of an electrode is 1 to 2 mm.

10. The low-pressure discharge lamp as claimed in claim 6, wherein the mercury-absorbing layer (6) has been provided on the startup element (1, 10) in such a quantity that the quantity of mercury released by the startup element at least compensates for the loss of mercury caused by adsorption in the starting phase of the lamp.

11. The low-pressure discharge lamp as claimed in claim 6, wherein the mercury-absorbing layer (6) has been provided on the startup element in such a quantity that said layer generates a vapor pressure of a few pascals in the lamp within a typical off time of the lamp of a few hours given complete evaporation.

12. A process for the production of a startup element for a low-pressure discharge lamp as claimed in claim 1 having the steps of a) providing a basic body (2), b) applying a mercury-absorbing layer (6) to the basic body, and c) providing a slurry which comprises titanium and applying said slurry to at least sections of the mercury-absorbing layer (6).

13. The process as claimed in claim 12, wherein, in step c), the application takes place by means of dip-coating.

14. The process as claimed in claim 12 further comprising a step d), which follows on from step c) and in which the basic body (2) coated with the mercury-absorbing layer and titanium is dried.

15. The process as claimed in claim 14 further comprising a step e), which follows on from step d) and in which steps c) and d) are repeated at least once.

* * * * *